US009140507B1

(12) United States Patent
Holmes

(10) Patent No.: US 9,140,507 B1
(45) Date of Patent: Sep. 22, 2015

(54) OBTURATOR SEAL APPARATUS AND METHOD

(71) Applicant: Edward William Holmes, Valley Falls, NY (US)

(72) Inventor: Edward William Holmes, Valley Falls, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 286 days.

(21) Appl. No.: 13/847,634

(22) Filed: Mar. 20, 2013

(51) Int. Cl.
*F41A 3/76* (2006.01)

(52) U.S. Cl.
CPC ..... *F41A 3/76* (2013.01)

(58) Field of Classification Search
None
See application file for complete search history.

(56) References Cited

U.S. PATENT DOCUMENTS 2,444,633 A * 7/1948 Crossley ..... 89/26
2,457,266 A * 12/1948 Oliver ..... 89/27.13
6,223,643 B1 * 5/2001 Muller ..... 89/26

FOREIGN PATENT DOCUMENTS

WO WO 97/44629 * 11/1997

* cited by examiner

*Primary Examiner* — Stephen M Johnson
(74) *Attorney, Agent, or Firm* — Henry S. Goldfine

(57) ABSTRACT

An obturator assembly for sealing the breech of a breech-loaded cannon includes a generally annular seal, a front split ring, a rear split ring, a rear inner ring, an annular disc, and a plurality of magnets disposed in the seal. The seal has a front portion with a leading angled surface and a rear portion. The rear portion includes a trailing angled surface and a flat surface. A plurality of magnets is disposed in holes in the leading angled surface of the front portion and in the flat surface of the rear portion. Magnets in the holes in the front portion hold the front split ring in abutment with the seal. Magnets in the holes in the rear portion hold the annular disc in abutment with the rear split ring and rear inner ring. The front split ring, rear split ring, rear inner ring, and annular disc may rotate with respect to the seal when the breech is opened or closed.

14 Claims, 3 Drawing Sheets

OBTURATOR SEAL APPARATUS AND METHOD

STATEMENT OF GOVERNMENT INTEREST

The inventions described herein may be manufactured, used and licensed by or for the United States Government.

BACKGROUND OF THE INVENTION

The invention relates in general to munitions and in particular to breech-loaded cannon.

Breech-loaded weapons that use bag ammunition require a seal at the breech to prevent propellant gases from passing to the rear into the threads or other parts of the breech mechanism. The traditional method of sealing a breech-loaded cannon uses a rubber donut-shaped ring between forward and rear split rings. The forward and rear split rings and the rubber donut-shaped ring are squeezed between a threaded breech block and the sealing cone of the cannon tube. The forward and rear split rings are able to move annularly about the axis of the spindle when the block is opened or closed. The traditional sealing approach was invented by DeBange in 1872. The DeBange obturator includes five independent parts. The obturator assembly must be inspected and cleaned daily or whenever residue or damage results in a high closing torqure.

A problem with the DeBange sealing method is, when the spindle is removed for daily inspection and cleaning of the obturator seal, the five parts of the obturator seal assembly tend to fall apart. Handling the loose parts is akin to a juggling act. The parts do not readily reassemble correctly. The parts may also fall into hard-to-reach areas where they are difficult to retrieve. In military operations, time is often critical. In addition, aligning and reassembling the parts of the obturator seal assembly typically requires two people.

The problem of loose parts was eliminated with the design of a "one-piece" obturator assembly known as the Crossley obturator and described in U.S. Pat. No. 2,444,633. The Crossley invention introduced new problems. The Crossley assembly uses front and rear rings that are riveted to the rubber donut-shaped ring. Each front and rear ring is comprised of three split segments or arcs. Unlike the DeBange split rings, the Crossley rings' three segments or arcs do not perfectly conform to the sealing cone diameters on the cannon tube. Moreover, the arcs are fixed to the rubber donut-shaped ring using rivets for each arc or segment. Consequently, the areas of the donut-shaped ring where the segmented portions of the rings intersect and flex and the areas of the donut-shaped ring that retain the rivets are repeatedly subjected to extreme burn wear. In addition, the rivets wear on and tear at the rubber donut-shaped ring because the breech block tends to twist the obturator pad (which is held by friction to the cannon tube) as the breech block is opened and closed. The cyclic wear of the Crossley obturator assembly is also high due to the unequal heat expansion of vastly different materials that are riveted together. If any component of the Crossley obturator assembly is damaged, the complete assembly is discarded.

There is a long-felt but unsolved need for an obturator assembly with the advantages of the Crossley and Debange obturator seal assembly designs, but without their disadvantages.

SUMMARY OF INVENTION

One aspect of the invention is an obturator assembly for sealing the breech of a breech-loaded cannon. The obturator assembly includes a central longitudinal axis and a generally annular seal centered on the central longitudinal axis. The generally annular seal includes a front portion and a rear portion. The front portion includes a leading angled surface. The rear portion includes a trailing angled surface and a flat surface contiguous with and radially inward of the trailing angled surface.

At least three holes are equally spaced circumferentially in the leading angled surface of the front portion. At least three holes are equally spaced circumferentially in the flat surface of the rear portion. The three holes in the flat surface are equally spaced circumferentially between the three holes in the leading angled surface. Magnets are disposed in each of the at least three holes in the leading angled surface and in each of the at least three holes in the flat surface.

A front split ring is centered on the central longitudinal axis in abutment to the leading angled surface. The front split ring is held in place by the magnets in the at least three holes in the leading angled surface. A rear split ring is centered on the central longitudinal axis and in abutment to the trailing angled surface. A rear inner ring is centered on the central longitudinal axis and disposed on the rear portion of the seal. An annular disc is centered on the central longitudinal axis and in abutment to rear surfaces of the rear split ring and the rear inner ring. The annular disc is held in place by the magnets in the at least three holes in the flat surface.

Magnetic force from the magnets in the leading angled surface and the magnets in the flat surface may be of a magnitude to permit rotation of the front split ring, the rear split ring, the rear inner ring, and the annular disc with respect to the seal when the breech of the cannon is opened and closed.

The at least three holes in the leading angled surface of the front portion may have respective central longitudinal axes that are normal to the leading angled surface. The at least three holes in the flat surface of the rear portion may have respective central longitudinal axes that are normal to the flat surface.

The magnets in the flat surface may be oriented in the same pole direction and the magnets in the leading angle surface may be oriented in the same pole direction. The magnets may comprise high-temperature super magnets. Each magnet may be covered with an elastomeric coating. Each magnet may have a cylindrical shape.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel obturator seal assembly for a breech-loaded cannon enables the components of the assembly to be held together as a single unit during disassembly. In contrast to the known Crossley assembly, the novel obturator seal assembly does not restrict the movement and/or conformation of the components of the assembly during operation of the cannon. In addition, as the breech block of the cannon is opened and/or closed, the components of the novel obturator seal assembly can move freely about the spindle both annularly and independently. The novel obturator seal assembly provides the advantages and benefits of unrestricted free movement and assembly cohesion.

Figure 1:
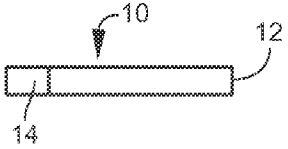
FIG. 1 is a schematic drawing of a breech-loaded cannon.

FIG. 1 is a schematic drawing of a breech-loaded cannon 10 having a muzzle 12 and a breech 14.

Figure 2:
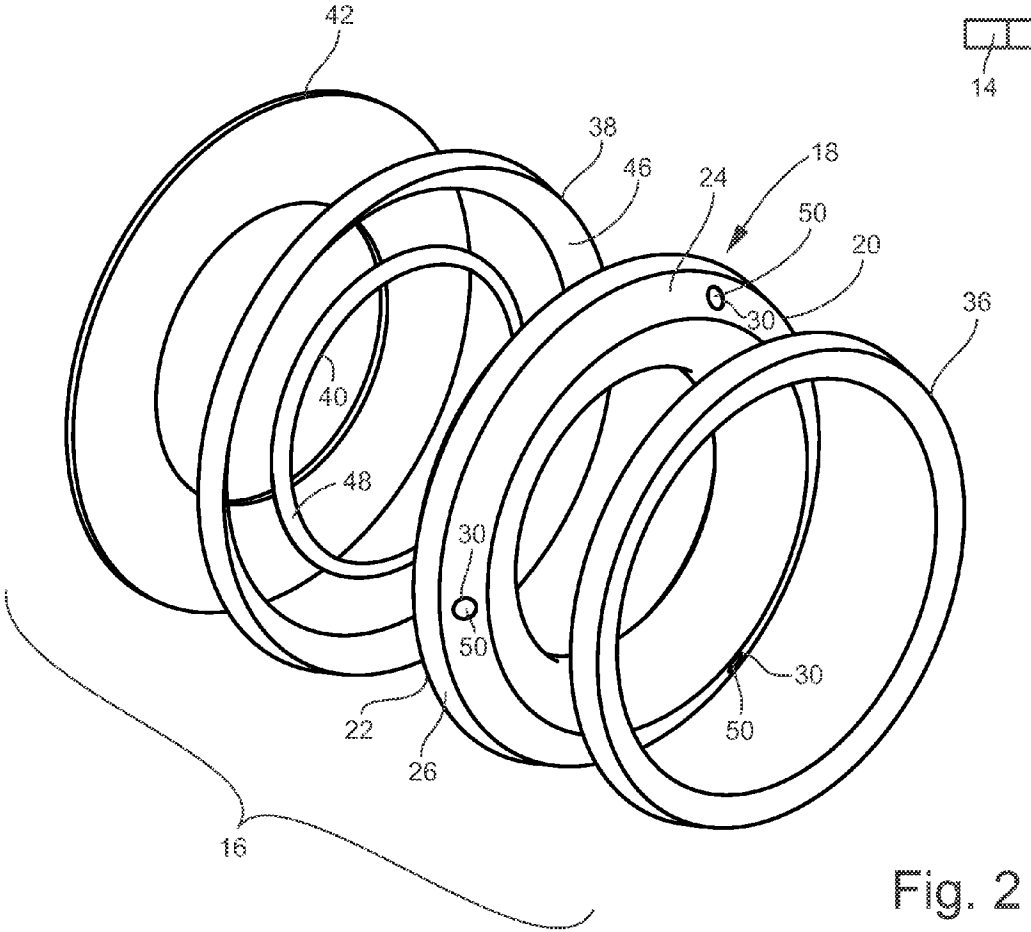
FIG. 2 is an exploded front perspective view of one embodiment of an obturator seal assembly.
Figure 4B:
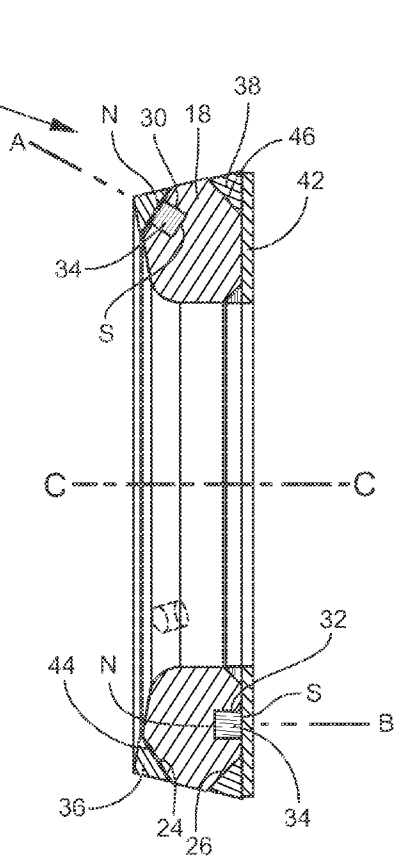
FIG. 4B is a sectional view taken along the line 4B-4B of FIG. 4A.
Figure 4A:
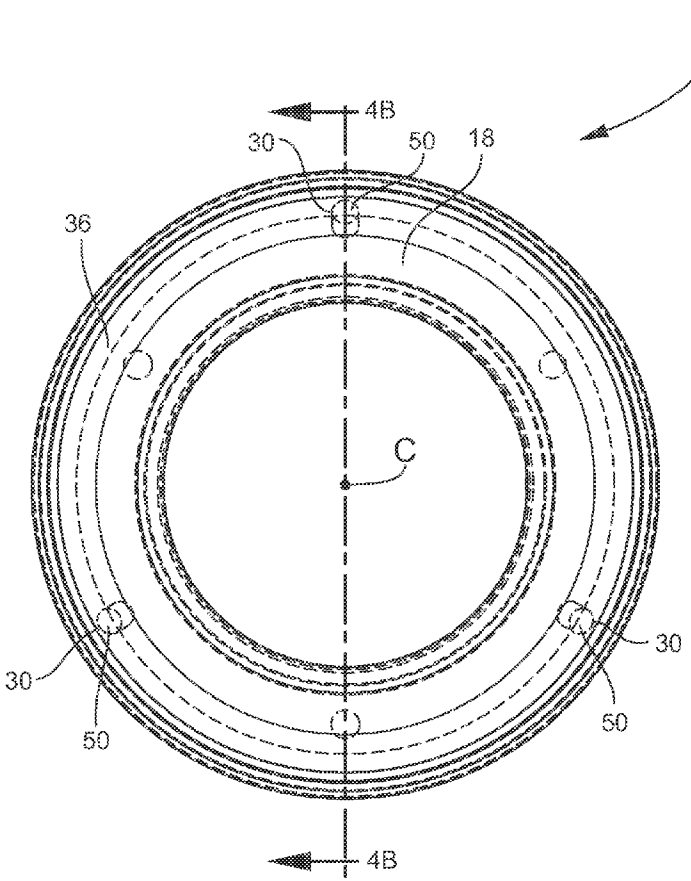
FIG. 4A is a front view of the embodiment shown in FIG. 2.

FIG. 2 is an exploded front perspective view of one embodiment of an obturator seal assembly 16 for use with cannon 10. Assembly 16 is centered on a longitudinal axis C (FIGS. 4A and 4B) and includes a generally annular seal 18, a front split ring 36, a rear split ring 38, a rear inner ring 40, an annular disc 42, and a plurality of magnets 34 (FIG. 4B). In a known manner, front and rear split rings 36, 38 are split radially at a single location.

Figure 3:
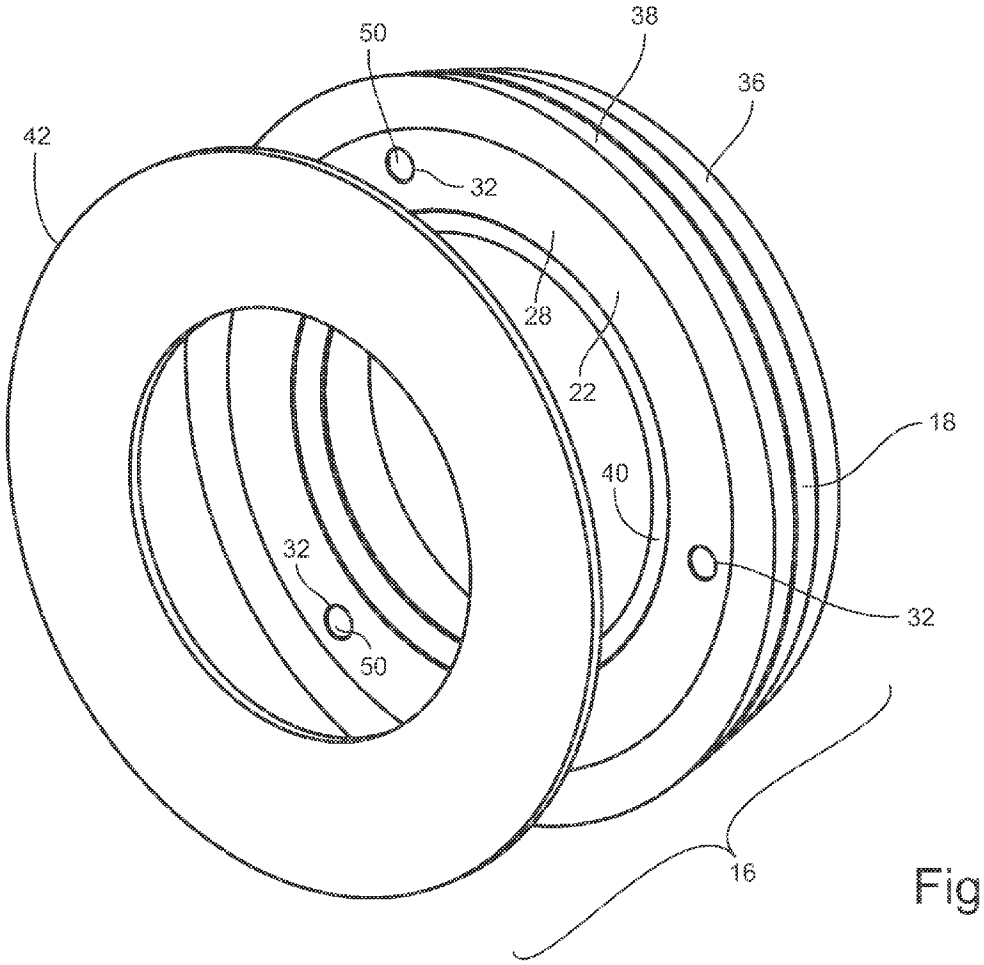
FIG. 3 is an exploded rear perspective view of the embodiment shown in FIG. 2.

Seal 18 is elastomeric and may be made of, for example, neoprene. Seal 18 has a front portion 20 and a rear portion 22. Front portion 20 includes a leading angled surface 24. As shown in FIG. 4B, leading angled surface 24 is angled with respect to axis C. Rear portion 22 of seal 18 includes a trailing angled surface 26 and a flat surface 28 (FIG. 3). As shown in FIG. 4B, trailing angled surface 26 is angled with respect to axis C. Flat surface 28 (FIG. 3) is contiguous with and radially inward of trailing angled surface 26.

A plurality of holes 30, equally spaced circumferentially, is formed in leading angled surface 24 of front portion 20. Preferably, there are at least three holes 30. As shown in FIG. 4B, the central longitudinal axis A of each hole 30 is normal to leading angled surface 24. A plurality of holes 32 (FIG. 3) is also formed in flat surface 28 of rear portion 22. Holes 32 are equally spaced circumferentially, and, preferably, are equally spaced circumferentially with respect to holes 30 in leading angled surface 24 such that all holes 30, 32 are equally spaced circumferentially. As shown in FIG. 4B, the central longitudinal axis B of each hole 32 is normal to flat surface 28.

Magnets 34 (FIG. 4B) are disposed in each of the holes 30, 32. Magnets 34 may be high-temperature super magnets. High-temperature super magnets are strong permanent magnets made from alloys of rare earth elements, for example, neodymium magnets and samarium-cobalt magnets. Magnets 34 may be cylindrical in shape. The poles of magnets 34 in holes 30, shown as N (North) and S (South) in the Figs., are oriented in the same direction. Similarly, the poles of magnets 34 in holes 32 are oriented in the same direction.

Front split ring 36 includes a surface 44 (FIG. 4B) that mates with and engages leading angled surface 24 of seal 18. Front split ring 36 is held in abutment to angled surface 24 by the magnetic force of magnets 34 disposed in holes 30. However, the magnetic force is not so great as to prevent front split ring 36 from rotating with respect to angled surface 24 when the breech 14 of cannon 10 is opened or closed.

Rear split ring 38 includes a surface 46 (FIGS. 2 and 4B) that mates with and engages trailing angled surface 26 of seal 18. Rear inner ring 40 includes a surface 48 (FIG. 2) that mates with and engages rear portion 22 of annular seal 18. An annular disc 42 abuts the rear surfaces of rear split ring 38 and rear inner ring 40. Annular disc 42, and, consequently, rear split ring 38 and rear inner ring 40, are held in place by the magnetic force of magnets 34 in holes 32. However, the magnetic force is not so great as to prevent rear split ring 38, rear inner ring 40, and annular disc 42 from rotating with respect to seal 18 when the breech 14 of cannon 10 is opened or closed.

Holes 30, 32 may be formed in annular seal 18 by drilling. Holes 30, 32 are of a size to enable the elastomer of seal 18 to grip magnets 34. As a result, no adhesive may be needed to position magnets 34 in holes 30, 32. Magnets 34 may be hand-pressed into holes 30, 32. Holes 30, 32 are of a depth to enable magnets 34 to be fully embedded in seal 18. An elastomeric coating 50 may be placed over magnets 34 to prevent wear on magnets 34 as rings 36, 38 and 40 turn or rotate.

Front split ring 36, rear split ring 38, rear inner ring 40, and annular disc 42 may be made of, for example, steel. In one embodiment, rear inner ring 40 and annular disc 42 may be a single integral piece to hinder transverse displacement of annular disc 42.

In addition to the benefits previously noted, the manufacturing method of assembly 16 is much simpler compared to the Crossley manufacturing method. Existing DeBange seals presently in use or in stock may be used as seals 18 in the inventive assembly 16.

While the invention has been described with reference to certain embodiments, numerous changes, alterations and modifications to the described embodiments are possible without departing from the spirit and scope of the invention as defined in the appended claims, and equivalents thereof.

What is claimed is:

1. An obturator assembly for sealing a breech of a breech-loaded cannon, the obturator assembly including a central longitudinal axis and comprising:

a generally annular seal centered on the central longitudinal axis and having a front portion and a rear portion, the front portion including a leading angled surface, the rear portion including a trailing angled surface and a flat surface contiguous with and radially inward of the trailing angled surface;

at least three holes equally spaced circumferentially in the leading angled surface of the front portion;

at least three holes equally spaced circumferentially in the flat surface of the rear portion, the three holes in the flat surface being equally spaced circumferentially between the three holes in the leading angled surface;

magnets disposed in each of the at least three holes in the leading angled surface and in each of the at least three holes in the flat surface;

a front split ring centered on the central longitudinal axis, in abutment to the leading angled surface, and held in place by the magnets in the at least three holes in the leading angled surface;

a rear split ring centered on the central longitudinal axis and in abutment to the trailing angled surface;

a rear inner ring centered on the central longitudinal axis and disposed on the rear portion of the seal; and an annular disc centered on the central longitudinal axis and in abutment to rear surfaces of the rear split ring and the rear inner ring, the disc being held in place by the magnets in the at least three holes in the flat surface.

2. The assembly of claim 1, wherein magnetic force from the magnets in the leading angled surface and the magnets in the flat surface is of a magnitude to permit rotation of the front split ring, the rear split ring, the rear inner ring, and the annular disc with respect to the seal when the breech of the cannon is opened and closed.

3. The assembly of claim 2, wherein the at least three holes in the leading angled surface of the front portion have respective central longitudinal axes that are normal to the leading angled surface.

4. The assembly of claim 3, wherein the at least three holes in the flat surface of the rear portion have respective central longitudinal axes that are normal to the flat surface.

5. The assembly of claim 4, wherein the magnets in the flat surface are oriented in a same pole direction and the magnets in the leading angle surface are oriented in a same pole direction.

6. The assembly of claim 5, wherein the magnets comprise strong permanent magnets made from alloys of earth metals.

7. The assembly of claim 6, wherein each magnet is covered with an elastomeric coating.

8. The assembly of claim 7, wherein each magnet has a cylindrical shape.

9. An obturator assembly for sealing a breech of a breech-loaded cannon, the obturator assembly including a central longitudinal axis and comprising:

an annular seal having a front portion and a rear portion, the front portion including a leading angled surface, the rear portion including a trailing angled surface and a flat surface contiguous with and radially inward of the trailing angled surface;

a plurality of holes equally spaced circumferentially in the leading angled surface of the front portion, the plurality of holes in the leading angled surface having respective central longitudinal axes that are normal to the leading angled surface;

a plurality of holes in the flat surface of the rear portion, the plurality of holes in the flat surface being equally spaced circumferentially between the plurality of holes in the leading angled surface, the plurality of holes in the flat surface having respective central longitudinal axes that are normal to the flat surface;

magnets disposed in each of the plurality of holes in the leading angled surface and in each of the plurality of holes in the flat surface;

a front split ring disposed on the leading angled surface and held in place by the magnets in the plurality of holes in the leading angled surface;

a rear split ring disposed on the trailing angled surface;

a rear inner ring disposed on the rear portion of the seal; and an annular disc in abutment with rear surfaces of the rear split ring and the rear inner ring, the annular disc being held in place by the magnets in the plurality of holes in the flat surface;

wherein magnetic force from the magnets in the leading angled surface and the magnets in the flat surface is of a magnitude to permit rotation of the front split ring, the rear split ring, the rear inner ring, and the annular disc with respect to the seal when the breech of the cannon is opened and closed.

10. The assembly of claim 9, wherein the magnets comprise strong permanent magnets made from alloys of earth metals.

11. The assembly of claim 10, wherein each magnet is covered with an elastomeric coating.

12. The assembly of claim 11, wherein each magnet has a cylindrical shape.

13. The assembly of claim 12, wherein the front split ring, the rear split ring, the rear inner ring, and the annular disc comprise steel.

14. The assembly of claim 13, wherein the magnets in the leading angled surface and the magnets in the flat surface are generally oriented in a same pole direction.

* * * * *